United States Patent [19]

Little

[11] Patent Number: 4,771,487

[45] Date of Patent: Sep. 20, 1988

[54] HAIR RINSING DEVICE

[76] Inventor: Richard L. Little, 37 Maisemore Gardens, Emsworth, Havant, Hampshire, P010 7JX, United Kingdom

[21] Appl. No.: 12,360

[22] Filed: Feb. 9, 1987

Related U.S. Application Data

[63] Continuation-in-part of Ser. No. 706,410, Feb. 28, 1985, abandoned, which is a continuation-in-part of Ser. No. 554,582, Nov. 23, 1983, abandoned.

[30] Foreign Application Priority Data

Nov. 24, 1982 [GB] United Kingdom ..... 8233567

[51] Int. Cl.[4] ..... A45D 19/08

[52] U.S. Cl. ..... 4/519

[58] Field of Search ..... 4/515–523; 132/9; 128/62, 65; 239/543, 544, 587

[56] References Cited

U.S. PATENT DOCUMENTS

| | | | |
|---|---|---|---|
| 2,813,275 | 11/1957 | Davenport | 4/517 |
| 2,854,970 | 10/1958 | Nolan | 4/517 X |
| 3,416,517 | 12/1968 | Adams et al. | 4/516 X |
| 3,599,250 | 8/1971 | Colomb | 4/517 |
| 3,732,580 | 5/1973 | Fava | 4/518 |
| 3,752,399 | 8/1973 | Neale et al. | 4/518 X |

*Primary Examiner*—Charles E. Phillips

*Attorney, Agent, or Firm*—Florence U. Reynolds

[57] ABSTRACT

The device comprises a basin having a wall with a U-shaped indentation for reception of a user's neck. A series of independently adjustable ducts, each of which incorporates several jet heads, each jet head having a number of nozzles arranged to direct streams of water radially inwards, are mounted on the basin. The ducts are connected to a common water inlet manifold and are adjustable to selected stationary positions such that the whole of the user's hair can be simultaneously rinsed. The jet heads are preferably linearly and/or rotationally adjustable with respect to the ducts. Rinsing water is caused to accumulate in a pool at the bottom of the basin by a weir running across the floor and preferably incorporating a narrow gap to provide controlled out-flow of water. The ducts may also be adapted to fit within a conventional backwash basin by means of suitable bracket means.

13 Claims, 10 Drawing Sheets

HAIR RINSING DEVICE

CROSS REFERENCE TO RELATED APPLICATIONS

This application is a continuation-in-part of application Ser. No. 706,410 filed Feb. 28,1985; which is a continuation-in-part of application Ser. No. 554,582 filed Nov. 23, 1983, now abandoned.

BACKGROUND OF THE INVENTION

This invention relates to hair rinsing devices, the term "rinsing" being used in this specification to include hair washing and applying to hair a treatment agent such as a solution of neutralizing agent. The hair rinsing devices according to the invention find particular, but not exclusive use, in the field of permanent waving.

Permanent waving is quite a complicated procedure which comprises the following steps:

(1) Washing the hair
(2) Rolling the hair in curlers
(3) Applying chemical solution A
(4) Allowing chemical solution A to take effect
(5) Rinsing the hair thoroughly
(6) Applying chemical solution B
(7) Allowing chemical solution B to take effect
(8) Removing the curlers
(9) Rinsing the hair
(10) Drying the hair The rinsing step (5) is critical as, if solution A is not completely rinsed away, the waving will fail and the whole procedure will have to be repeated. As complete rinsing is so important, a rinsing time of ten minutes is recommended and the hairdresser must ensure that the most dense portions of hair receive the most attention. Clearly the rinsing step is tedious to perform, tending to lead to lapses of concentration on the part of the hairdresser with the consequence that patches of hair may not be completely rinsed and the waving fails.

Numerous devices have been proposed to reduce the labor involved in permanent waving and in performing other hair treatments. These devices require the use of pumps, motors or complicated mechanical movements in order to achieve the desired result; and in most cases the use of guards or total enclosures for the head are necessary to prevent splashing and fluid loss, in particular from fluid directed upwardly at the back of the user's head. Most of these devices include a hood or helmet which fits over the head and has its edges in sealing engagement therewith. Such devices tend to be uncomfortable to wear and impair inspection of the hair during treatment. Typical of such devices and one which also incorporates a small basin, above which the user's head is supported, is the automatice hair dressing apparatus disclosed in UK Pat. No. 1,272,394 (Parker). This apparatus comprises two head segments, each of which is mounted at one end for oscillatory movement, the other end being resiliently urged into sealing engagement with the user's head. A spray head is mounted on each segment as well as brush or sponge pads. In use the segments are driven by an electric motor to oscillate together about an axis approximately parallel to the user's neck.

SUMMARY OF THE INVENTION

According to the present invention, these problems are largely overcome by the provision of a hair rinsing device comprising a basin for receiving the head of a person whose hair is to be rinsed, spray means for forming a spray constituted by a plurality of individual streams of water and comprising a number of ducts, each provided with a series of nozzles and each arranged to be independently adjustable to a stationary position such that the whole area of hair unobstructed by the floor of the basin is, in use, simultaneously exposed to said spray.

Although this arrangement is generally satisfactory, it has been found that with certain head shapes and when using certain recent, very thick perm solutions, reliance could not be placed on the hair itself to transmit rinsing water and thus rinse areas of of hair between the individual streams.

According to the most preferred embodiment of the present invention, this drawback is overcome by the provision of nozzles which are adjustable with respect to the ducts.

Preferably the ducts are constituted by rectangular-form hoops and are pivotally mounted on the basin. Preferably again, the nozzles are grouped in jet heads which are linearly and/or rotationally adjustable with respect to the ducts.

In a preferred embodiment a weir extends across the bottom of the basin to form a swirl-pool in which hair at the back of the head may lie for prolonged contact with rinsing water. Preferably, the weir contains a small gap to provide positive controlled flow.

Although the above arrangement is entirely satisfactory in operation, it has been found that hairdressers are reluctant to replace an existing basin with the special type of basin forming part of the device described above.

Therefore, in a further embodiment of the present invention there is provided a hair rinsing device which can be mounted in any standard backwash basin.

The mounting means desirably comprise a pair of brackets secured to the work surface one on each side of the basin. Preferably again each bracket is arranged to support a respective block and extends downwardly into the basin.

With the use of the device according to the present invention all hair rinsing operations may be performed within the basin and with the most efficient use of the available water or solution.

The device of the present invention does not rely on mechanical movement of the sprays during rinsing in order to achieve full coverage, nor on sequential operation of groups of spray heads, and is thus much simpler and cheaper to produce than the elaborate prior art devices. Moreover, the user's head is not in contact with the device save where the neck rests on the wall of the basin, thus minimizing discomfort to the user and permitting observation of the rinsing operation throughout its course. It will be appreciated that the basin and jets are normally so arranged that the jets are always directed into the basin whatever the position of the spray means.

A particular advantage afforded by the devices according to the present invention is that they are far less forbidding to the customer than the prior art devices, many of which resemble instruments of torture rather than aids to better and more efficient hairdressing.

BRIEF DESCRIPTION OF THE DRAWINGS

Embodiments of the invention will now be described, by way of example, with reference to the accompanying drawings in which.

DETAILED DESCRIPTION OF PREFERRED EMBODIMENTS

Figure 1:
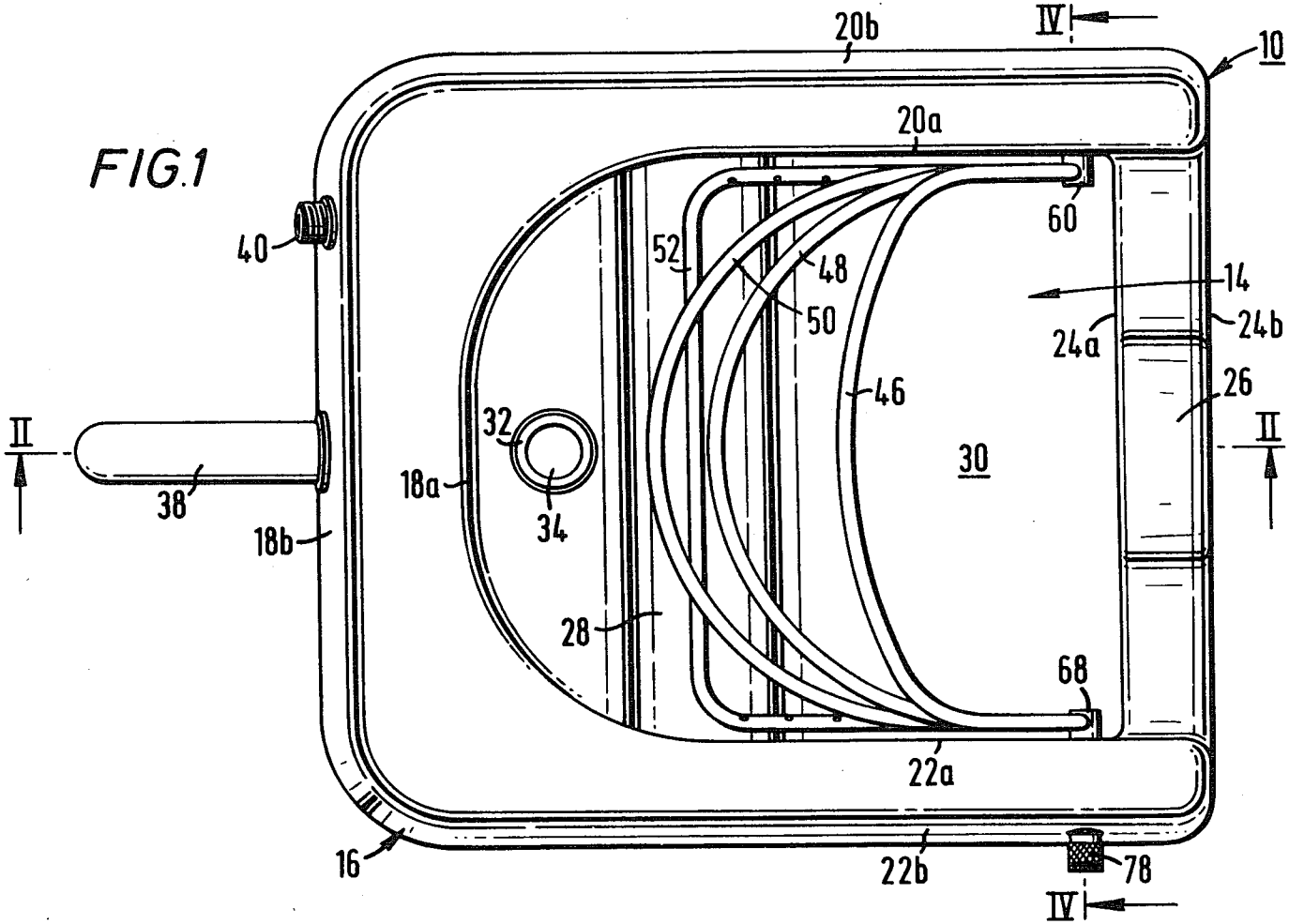
FIG. 1 is a plan view of a hair rinsing device according to the invention.
Figure 2:
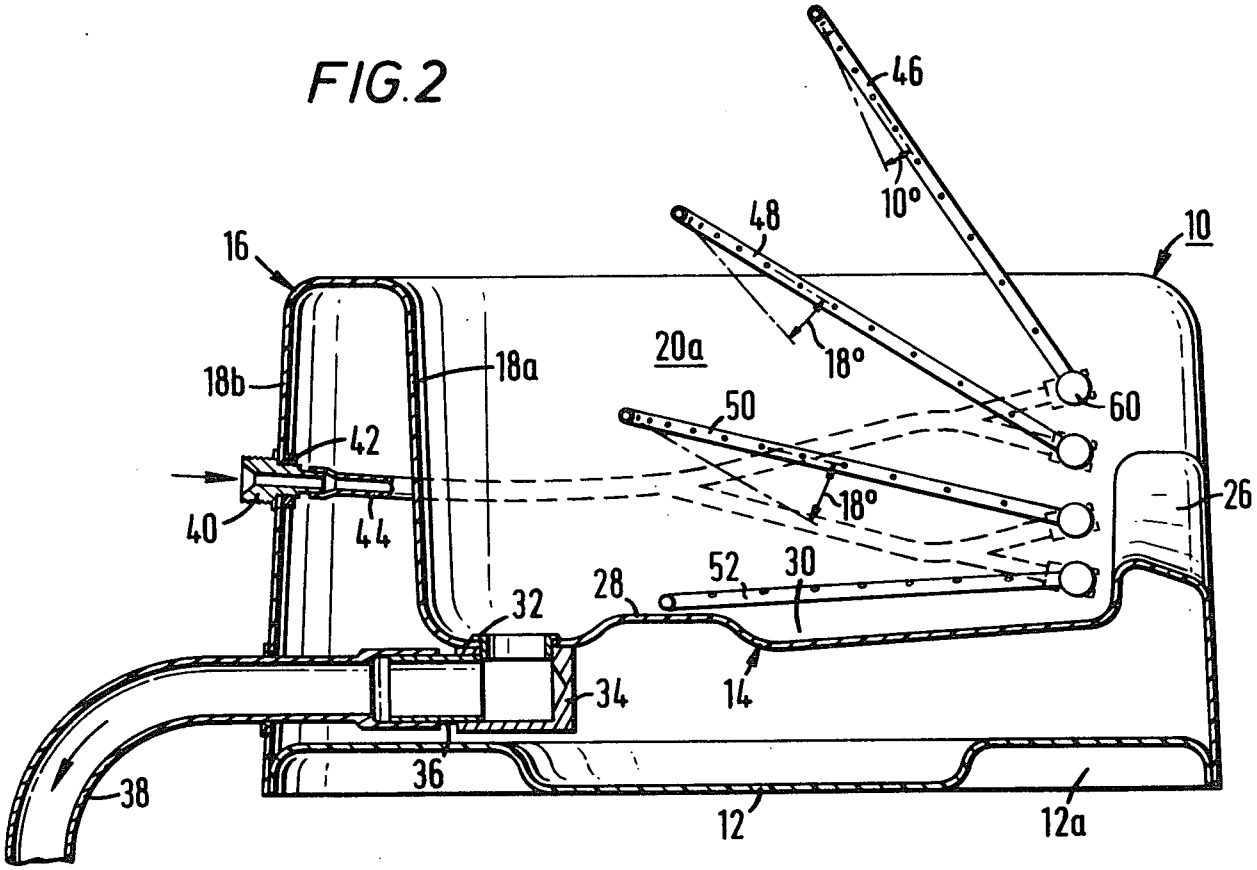
FIG. 2 is a section on the line II—II in FIG. 1.
Figure 3:
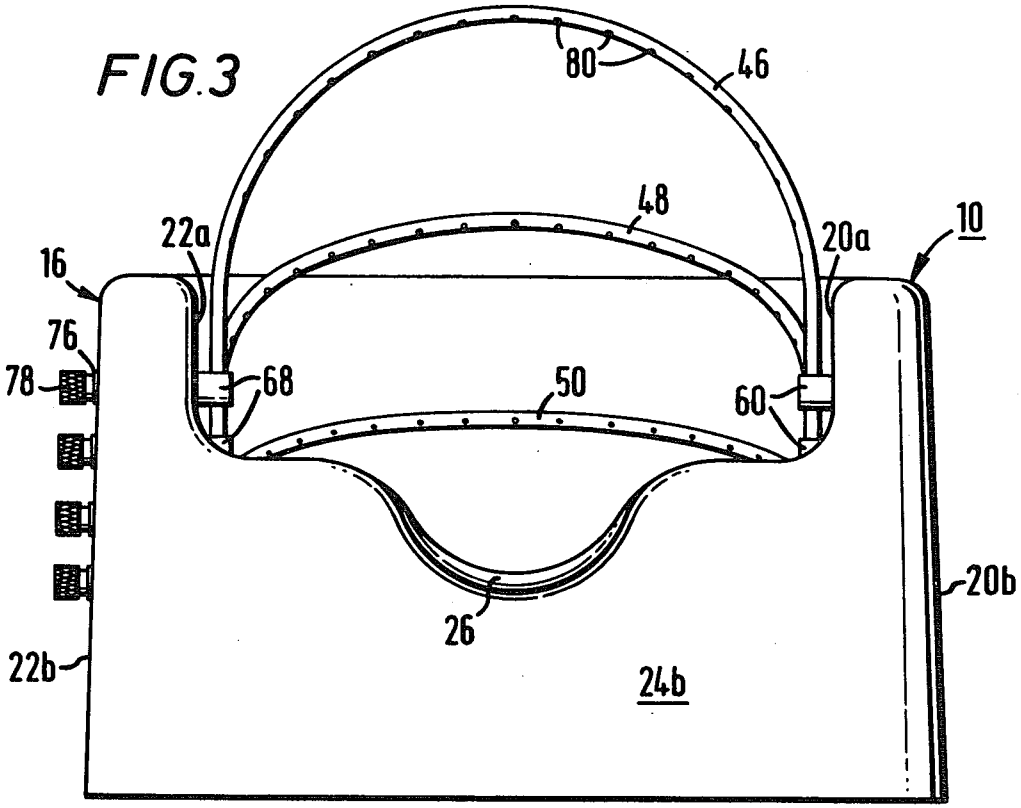
FIG. 3 is an elevation of the device, taken from the neckreceiving end.

The hair rinsing device shown in FIG. 1 consists essentially of a basin 10 molded from plastic material, and spray means (to be described later) mounted thereon.

The basin 10 comprises a base 12 formed with a peripheral recess 12*a* which serves to locate the device on a stand, and an upper portion consisting of a floor 14 and an integrally molded wall 16 of generally inverted U-section having an inner head end portion 18*a*, an outer head end portion 18*b*; two inner side portions 20*a*, 22*a*; two outer side portions 20*b*, 22*b*; and an inner neck end portion 24*a* and an outer neck end portion 24*b*, the portions 24*a*, 24*b* being generally lower and molded with a central U-shaped indentation 26 for receiving and supporting a user's neck. The floor 14 is provided with a transverse sill 28 which forms between it and the inner neck end wall portion 24*a*, a swirl-pool area 30.

Between the sill 28 and inner head end wall portion 18*a* there is positioned a drain comprising a flange 32, L-shaped adaptor 34 and spigot 36 on which is received a flexible drain hose 38 passing out through the outer head end wall portion 18*b*.

A water inlet connector 40 for connection to an adjustable temperature water supply passes through the outer head end wall portion 18*b* in a position above and offset from the drain hose 38 and is secured by a screw-threaded flange 42. The inner end of the connector 40 receives an end of the branched supply ducting 44 which lies between the side wall portions 20*a*, 20*b*.

Figure 4:
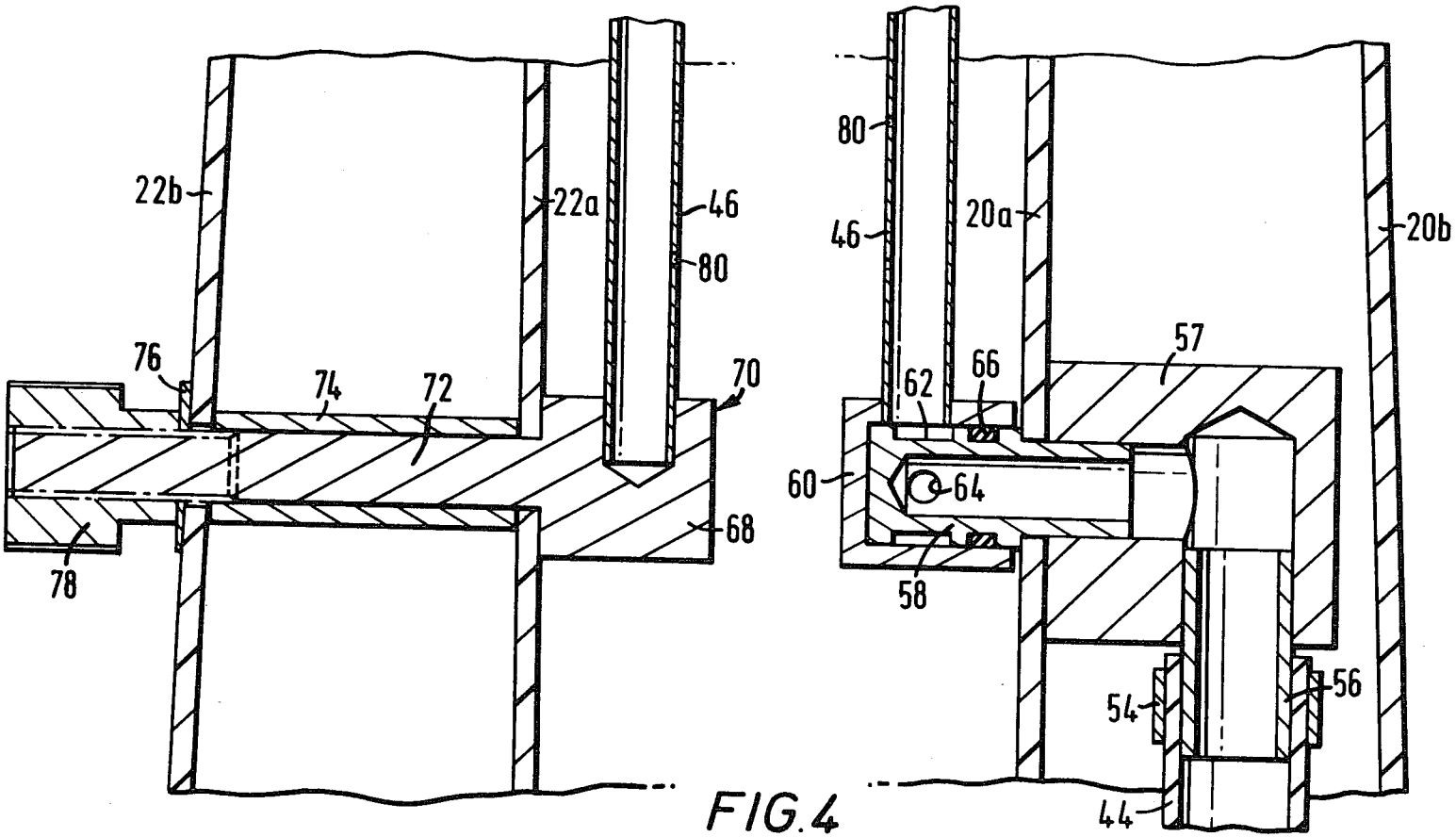
FIG. 4 is a detail of a hoop, being an enlarged fragmentary section on the line IV—IV in FIG. 1.
Figure 5:
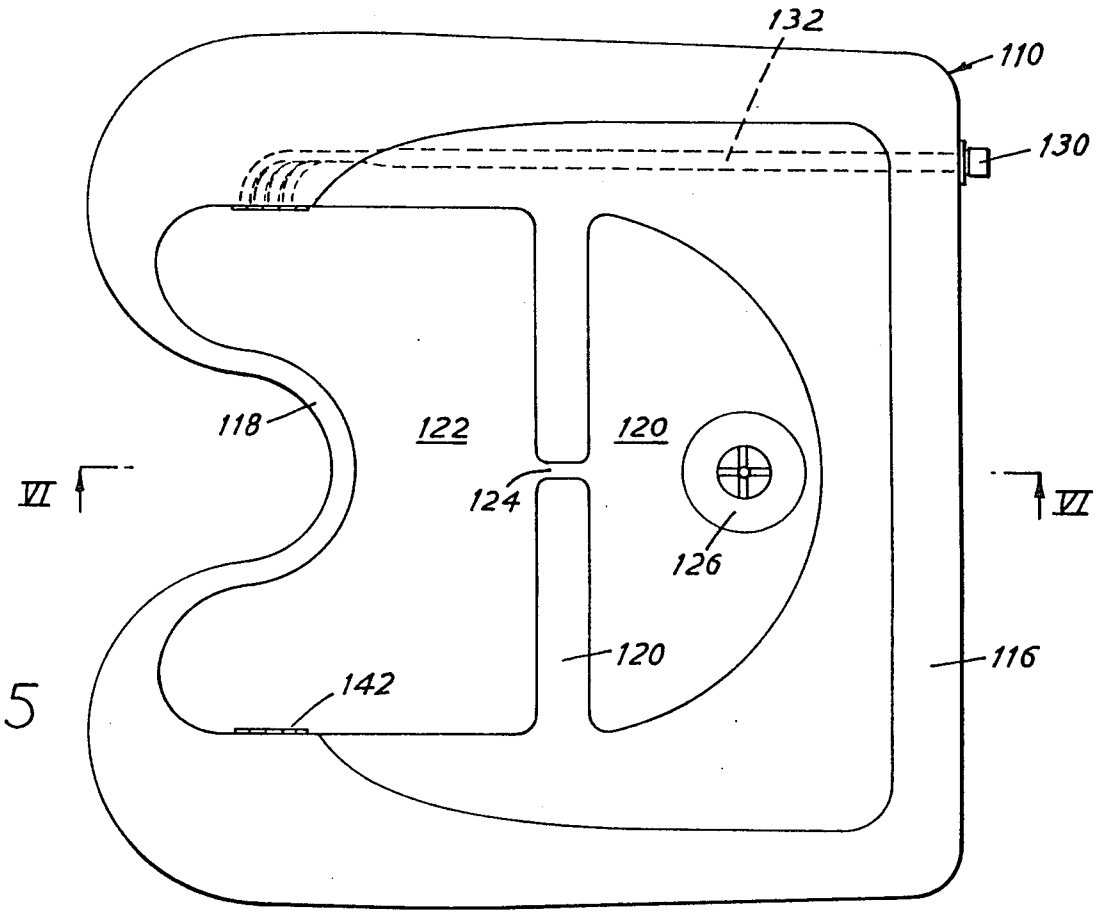
FIG. 5 is a plan view of the basin of a hair rinsing device according to the invention showing details of the weir.

Three arcuate hoops 46, 48, 50 and a rectangular-form hoop 52 constituting spray means are mounted across the basin 10. The details of the identical mountings are best shown in FIG. 4 which is a section through the hoop 46. On the inlet side (right hand side as seen in FIG. 4) the end of one of the branches of the supply ducting 44 is secured by a clip 54 to a tube 56 projecting radially from a 90° adaptor 57, the outlet end of which receives a hollow spigot 58 secured in an aperture in the inner side wall portion 20*a*. Rotatably mounted on the projecting end of the spigot 58 is a cap 60 the wall of which is drilled to receive the inlet end of the hoop 46. The spigot 58 is provided with an annular channel 62 opposite the end of the hoop 46, the channel 62 communicating with the hollow interior of the spigot 58 by a radial passage 64. Leakage between the cap 60 and spigot 58 is prevented by an 0-ring seal 66. The spigot 58 and cap 60 thus constitute a swivel joint through which the hoop 46 receives a supply of water from the ducting 44.

At its other, closed end the hoop 46 is received in a radial aperture in the head 68 of a swivel piece 70, the shank 72 of which is rotatably received in apertures in the side wall portions 22*a*, 22*b* between which it is surrounded by a spacer 74. The outer, threaded end of the shank 72 receives a washer 76 and locking nut 78, by means of which the hoop 46 can be secured at any desired position between the horizontal and a raised position.

The hoop 46 is drilled at an angle of 10° to the plane thereof so as to form numerous small apertures 80 which, in use, direct streams of water downwardly with respect to the plane of the hoop and the hoops 48, 50 are similarly drilled at an angle of 18° . The hoop 52 is drilled only along its side arms at an angle of 25° in the opposite direction so that the streams of water are upwardly directed.

For use the inlet connector of the hair-rinsing device is connected to an adjustable-temperature supply of water. The head of the user whose hair is to be washed is then placed face upwards in the basin 10 with the neck resting in the indentation 26. The hoops 46, 48, 50, 52 are pivoted after the water supply has been turned on so that the spray formed by the streams of water issuing through the apertures 80 gives complete coverage of the hair, depending on the head shape and hair style. The hoops are locked in the desired positions by screwing up the lock nuts. The head is allowed to remain in position for the recommended rinse time, at the end of which the hair will be completely rinsed and free of any previously applied chemical solution.

In the preferred embodiment (FIGS. 5–8), which constitutes the best mode contemplated by the inventor, the basin 110 is secured to a work surface 112 by bolts 114 and has an integral double wall 116. At the projecting front end portion of the basin 110, the wall 116 is recessed and lowered to provide a neck support 118. Across the central portion of the floor two transverse ridges 120 extend inwardly to form at the front end portion of the basin 110 a swirl-pool area 122 from which water may flow through the run-away 124 defined by the inner ends of the ridges 120 to an outlet 126 projecting through the work surface 112 and connected to a drain tube 128.

A water supply inlet connection 130 is mounted in the outer rear wall 116 and connected by a branched primary duct 132 to four fixed hollow spigots 134 projecting through the inner side wall of the basin 110, each of which rotatably receives a boss 136. Each boss 136 has a radial bore for receiving one end of a rectangular-form hoop duct 138 spanning the basin 110 and an axial bore to allow fluid communication between the spigot 134 and the radial bore. The other end of each hoop duct 138 is blanked off by being located in a similar, but solid, boss 140 and spigot 142 mounted on the opposite inner wall 116 of the basin 110.

On each of the radially-extending side portions 144 of each hoop duct 138 is slidably and rotatably received a generally square-section jet head 146 having a hollow rubber body 148 which is in fluid communication with the interior of the duct 138 through a flow window 150. Inset into one face of the body 148 is a jet panel 152 having three convexly-disposed longitudinal faces, each of which is apertured to form a line of nozzles 154 therealong; the panels 152 are detachable for descaling. A similar, but longer, jet head 156 is mounted on the intermediate portion 158 of each hoop duct 138 bridging the two side portions 144.

Figure 6:
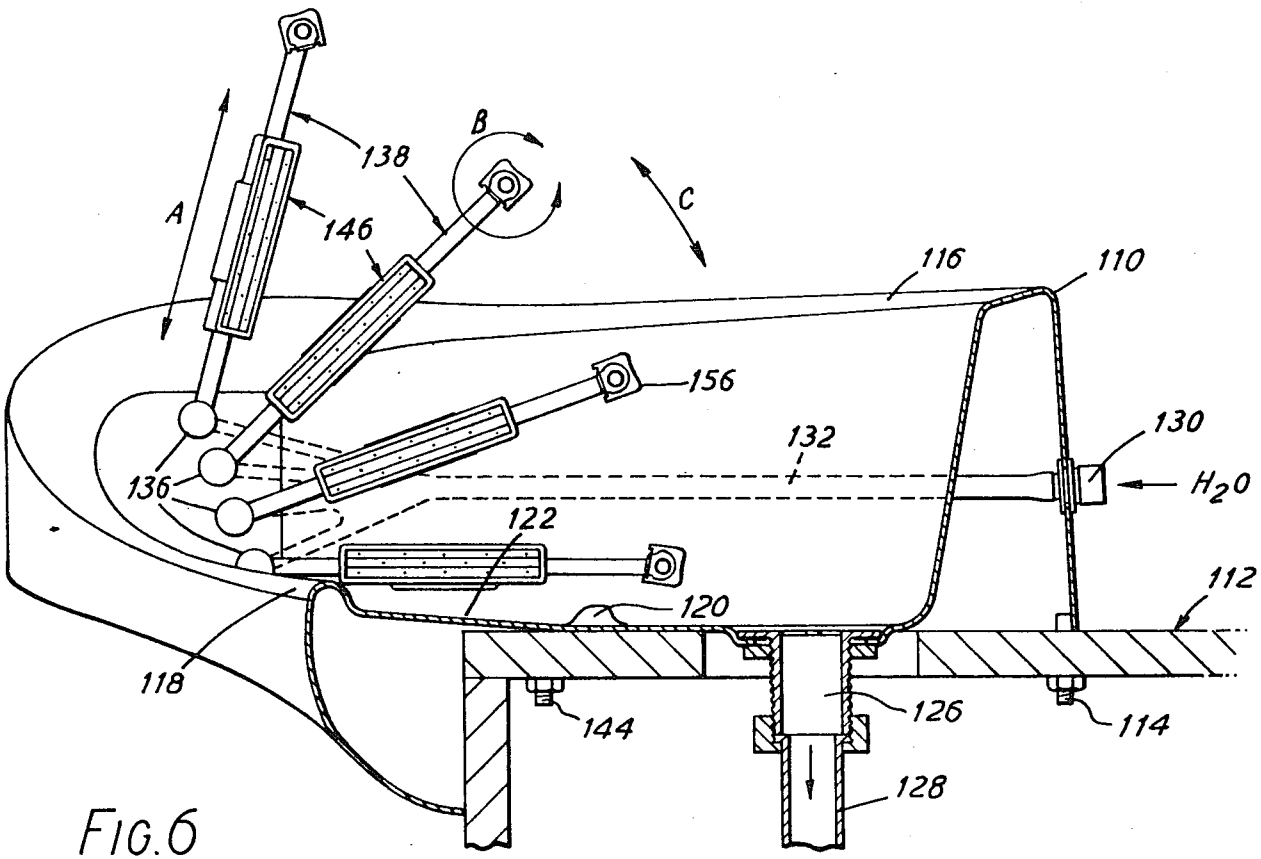
FIG. 6 is a section on the line VI—VI- in FIG. 5.
Figures 7, 8:
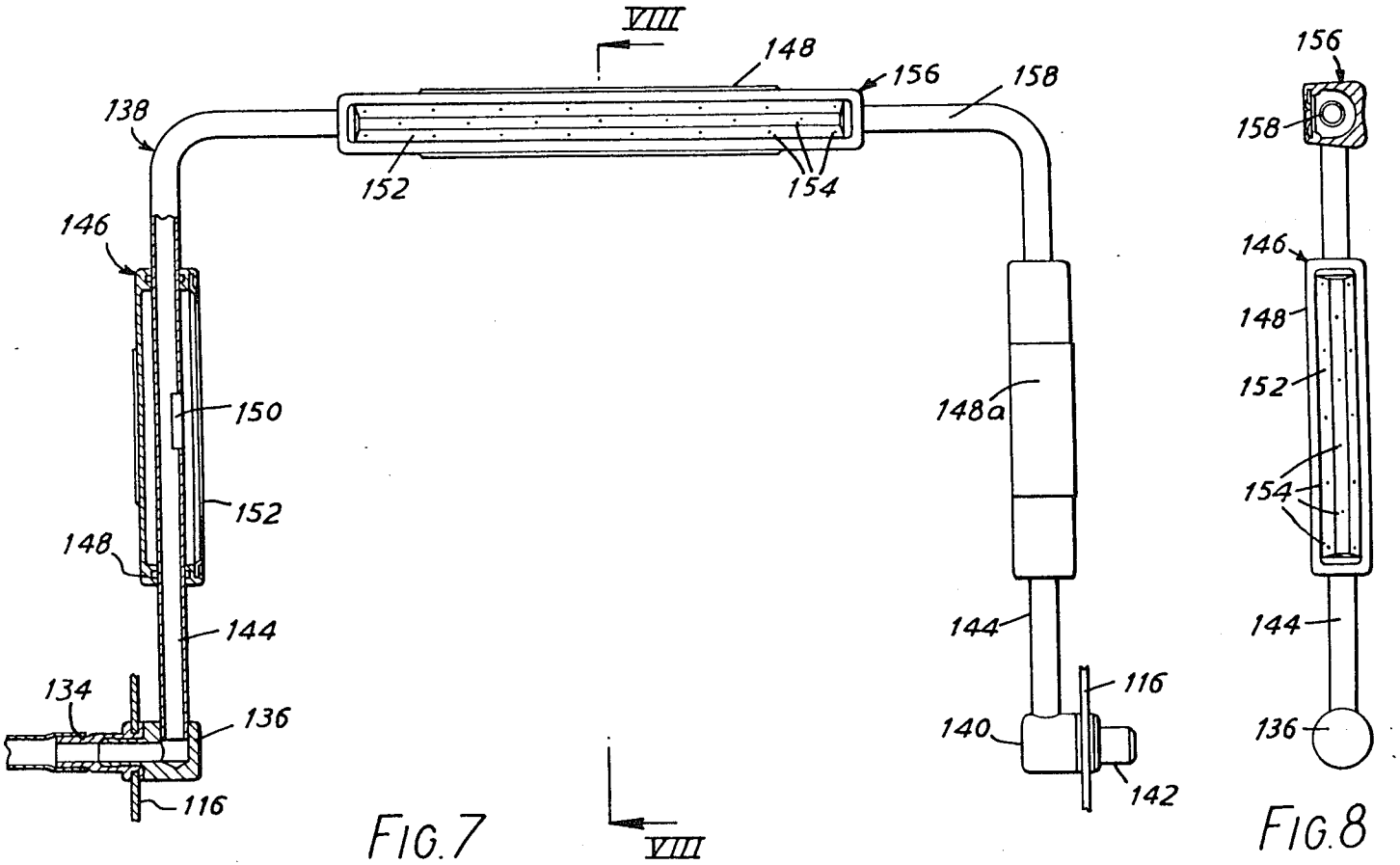
FIG. 7 is an elevation of a duct, on an enlarged scale and in partial section.
FIG. 8 is a detail of a duct, being an enlarged fragmentary section on the line VIII—VIII in FIG. 7.
Figure 9:
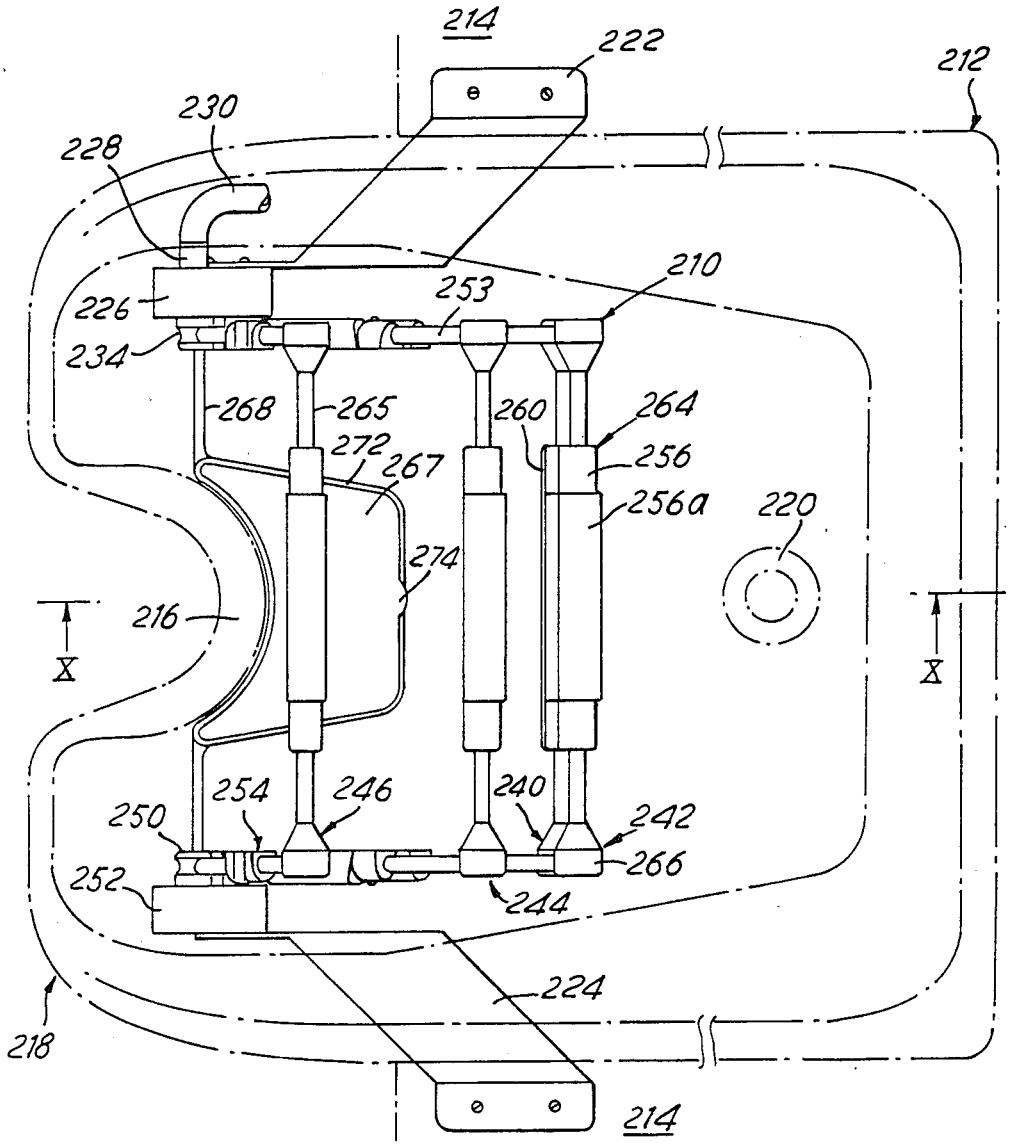
FIG. 9 is a plan view of a hair rinsing device according to the invention showing attaching brackets.
Figure 10:
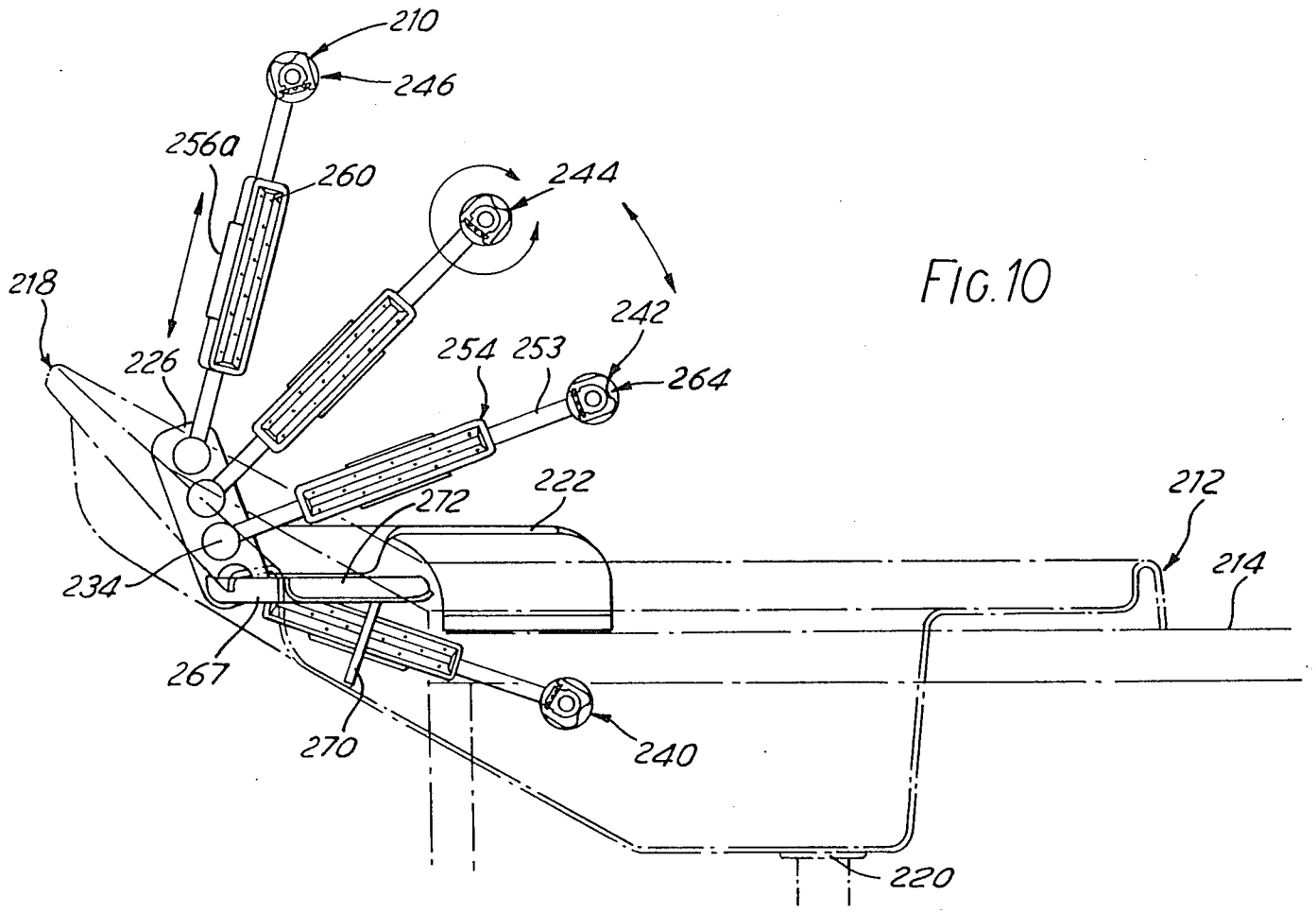
FIG. 10 is a section on the line X—X in FIG. 9.
Figure 12:
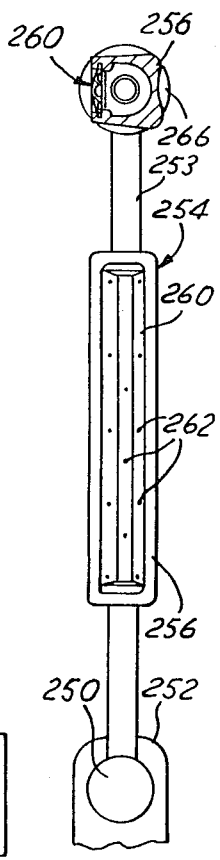
FIG. 12 is a detail of a duct, being an enlarged fragmentary section on the line XII—XII in FIG. 9.
Figure 11:
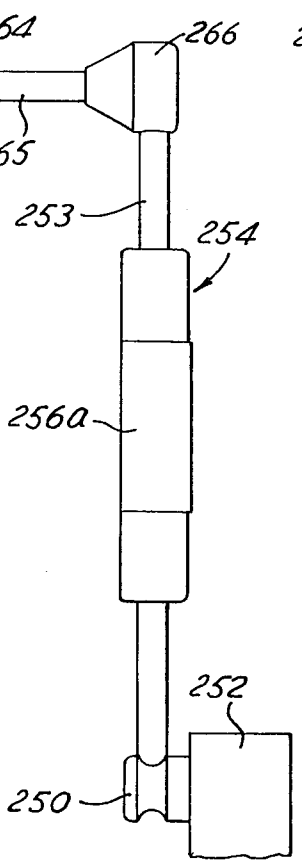
FIG. 11 is an elevation of a duct, on an enlarged scale and in partial section.
Figure 11:
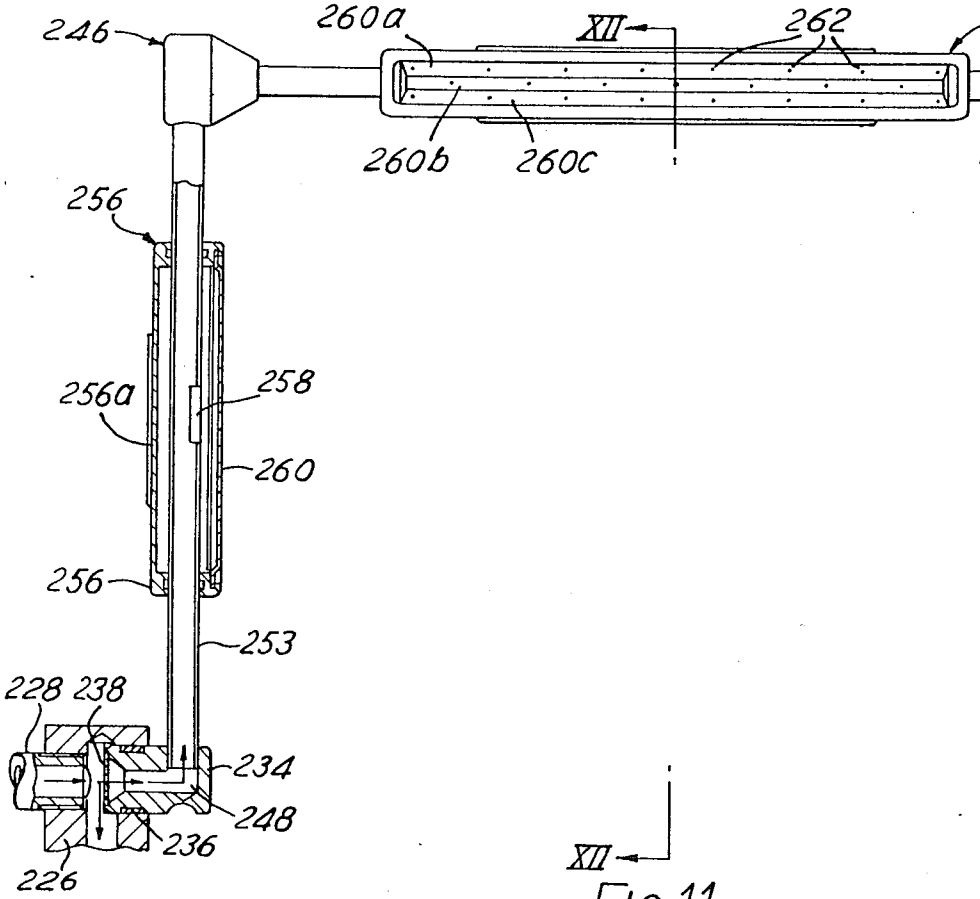

In FIG. 6, arrow A indicates the linear jet adjustment direction, arrow B indicates the rotary jet adjustment direction and arrow C indicates the radial duct adjustment direction.

For use the inlet connector 130 of the hair-rinsing device is connected to an adjustable-temperature supply of water. The head of the user whose hair is to be washed is then placed face upwards in the basin 110 with the neck resting on the neck support 118 and with the hoop ducts 138 all positioned horizontally. After the water supply has been turned on, the hoop ducts 138 are pivoted upwardly roughly to the positions shown in FIG. 6 and the jet heads 146 are slid along the respective portions of the hoop ducts 138 and rotated until the spray formed by the streams of water issuing through the nozzles 154 gives complete coverage of the exposed hair, depending on the head shape and hair style. The saddle-form thickening 148*a* of each jet head body 148 facilitates the positioning of the jet head by providing a finger grip and also a positive indication of the orientation of the jets before the water is turned on. The head is allowed to remain in position for the recommended rinse time, at the end of which the hair will be completely rinsed and free of any previously applied chemical solution.

Rinsing water accumulating in the swirl-pool area 122 provides a pool in which hair at the back of the head can lie for continuous immersion; it will be appreciated that the run-away 124 controls the flow of water through the swirl-pool area 122 and promotes a positive rinsing flow therethrough. The height of the wall 116 effectively confines the water within the basin 110 and obviates the need for enclosing the head within a hood.

The hair rinsing device 210 shown in FIGS. 9–12 is fitted within a conventional backwash basin 212 recessed into a work surface 214 and having a neck support 216, formed by a lowered portion of the rim at the projecting front end portion 218, and a drain 220.

Screwed to the work su face 214 on each side of the basin 212 are brackets 222, 224 which extend forwardly over the rim of the basin 212 and down into the front end portion 218 thereof. To the bracket 222 is secured a water inlet manifold 226 having on the outer side a connection 228 to a water inlet hose 230 which is itself connected to mixer taps (not shown). On the inner side of the manifold 226 are four bores each rotatably receiving a boss 234 with the interposition of a friction swivel joint seal 36. Each boss 234 has a filter 238 fitted over its inner end and at its outer end has a radial bore for receiving one end of respective rectangular-form hoop ducts 240, 242, 244, 246 spanning the basin 212. Fluid communication between the radial bore and the interior of the manifold 226 is achieved by an axial bore 248. The other end of each hoop duct 240–246 is blanked off by being received in the radial bore of a boss 250 having no axial bore, but which is otherwise similarly mounted in a solid block 252 resembling the manifold 226.

On each side arm 253 of the hoop ducts 240–246 is slidably and rotatably received a generally square-section jet head 254 having a hollow rubber body 256 which is in fluid communication with the interior of the respective ducts 240–246 through a flow window 258. Inset into one face of the body 256 is a jet panel 260 having three convexly-disposed longitudinal faces, 260*a*, 260*b*, 260*c*, each of which is apertured to form a line of nozzles 262 therealong; the panels 260 are detachable for de-scaling. A similar but longer jet head 264 is mounted on the bridging portion 265 of each hoop duct 240–246 which is connected at each end to the respective side arms 253 through a flow joint 266.

A swirl pool tray 267 is mounted between the manifold 226 and block 252 by means of spigots 268 extending on each side of the tray 267, which is supported on a strut 270 resting on the floor of the basin 212. The tray has a peripheral rim 272 interrupted at 274 to provide a controlled runaway.

In an alternative embodiment the mounting means may take the form of suction means for securing the device to the floor of a backwash basin. Preferably, the suction means are suckers mounted on a framework which is conveniently the lowermost hoop duct modified so as to be fixed and lie within the basin.

The device may be modified by fitting process timers and/or an indicator to indicate the state of neutralization or cleanliness of the water draining from the hair. Provision may also be made for the introduction of a neutralizing agent into the water inlet.

The orientation of the nozzles is always downwards when the water is flowing without the customer's head in position. But when the head is positioned for rinsing, then the nozzles may be turned in any direction except directly upwards as the head itself will prevent the water falling on the floor. Moreover, the combination of the downward direction and upward direction of the streams from the upper and lower hoops, respectively, ensure the most beneficial rinsing action.

Although the invention has been illustrated by reference to specific embodiments thereof, it is to be understood that other variations and modifications can be made without departing from the scope of the invention as defined in the appended claims.

I claim:

1. A hair rinsing device comprising a basin for receiving the head of a person whose hair is to be rinsed, a plurality of ducts, a plurality of jet heads mounted on each of said ducts, a plurality of nozzles incorporated in each of said jet heads for forming a spray constituted by a plurality of individual streams of water, each head being rotatably adjustable about and linearly adjustable along a longitudinal axis of each said duct, adjustable mounting means enabling the ducts to be adjusted independently to selected stationary positions so that the whole area of exposed hair is simultaneously rinsed, a common water inlet manifold for connecting the ducts simultaneously to a water supply, and drain means for draining water from the basin.

2. The device as claimed in claim 1, in which said ducts are tubular hoops arranged to direct said streams radially inwards.

3. The device as claimed in claim 2, in which said hoops are rectangular in form.

4. The device as claimed in claim 2, in which said mounting means enable each hoop to be pivoted between a first position in which it lies in a plane parallel to the mouth of the basin and a second, raised position.

5. The device as claimed in claim 4, in which at least one of said hoops is arranged to direct the streams issuing therefrom downwardly into the basin when the respective hoop is in said first position.

6. The device as claimed in claim 1, further comprising a weir for retaining a pool of water at the bottom of the basin.

7. The device as claimed in claim 6, in which said weir has a gap to provide positive controlled out-flow of water.

8. The device as claimed in claim 1, in which a portion of the wall of the basin is formed with a U-shaped profile for receiving and supporting the neck of the user.

9. The device as claimed in claim 1, in which each jet head comprised a jet panel having three convexly-disposed longitudinal faces.

10. The device as claimed in claim 1, in which said ducts are tubular hoops which are rectangular in form.

11. The device as claimed in claim 1 further comprising a tray forming a weir for retaining a pool of water at the bottom of the basin.

12. The device as claimed in claim 11, in which said weir has a gap to provide positive controlled out-flow of water.

13. The device as claimed in claim 1 further comprising bracket means for suspending said ducts over said basin.

* * * * *